US005233958A

United States Patent [19]

Knoss et al.

[11] Patent Number: 5,233,958

[45] Date of Patent: Aug. 10, 1993

[54] ARRANGEMENT FOR THE OPEN-LOOP AND/OR CLOSED-LOOP CONTROL OF AN OPERATING VARIABLE OF AN INTERNAL COMBUSTION ENGINE

[75] Inventors: Martin Knoss, Asperg; Bernd Lieberoth-Leden, Leonberg; Diethard Loehr, Schwieberdingen, all of Fed. Rep. of Germany

[73] Assignee: Robert Bosch GmbH, Stuttgart, Fed. Rep. of Germany

[21] Appl. No.: 793,830

[22] Filed: Nov. 18, 1991

[30] Foreign Application Priority Data

Nov. 16, 1990 [DE] Fed. Rep. of Germany ..... 4036566

[51] Int. Cl.[5] ..... F02D 41/22

[52] U.S. Cl. ..... 123/396; 123/359; 123/399

[58] Field of Search ..... 123/396, 397, 399, 198 D, 123/359

[56] References Cited

U.S. PATENT DOCUMENTS 4,509,480 4/1985 Kull et al. ..... 123/359
4,515,125 5/1985 Buck et al. ..... 123/359
4,519,361 5/1985 Murakami ..... 123/399

OTHER PUBLICATIONS

"Elektronische Motorsteuerung für Kraftfahrzeuge" by G. Kolberg, Motortechnische Zeitschrift, 46th year, vol. 4, 1985.

*Primary Examiner*—Andrew M. Dolinar
*Attorney, Agent, or Firm*—Walter Ottesen

[57] ABSTRACT

The invention is directed to an arrangement for the open-loop and/or closed-loop control of an operating variable of an internal combustion engine. The arrangement includes an electronic open-loop and closed-loop control unit which is influenced with an actuable positioning component operating on the operating value in dependence upon at least one operating variable. This arrangement includes at least one safety means which changes its signal condition in predetermined positions of the actuator. Devices are included for precisely determining and detecting the position of the signal condition change. These devices control the actuator in predetermined operating conditions independently of the operating variable.

16 Claims, 3 Drawing Sheets

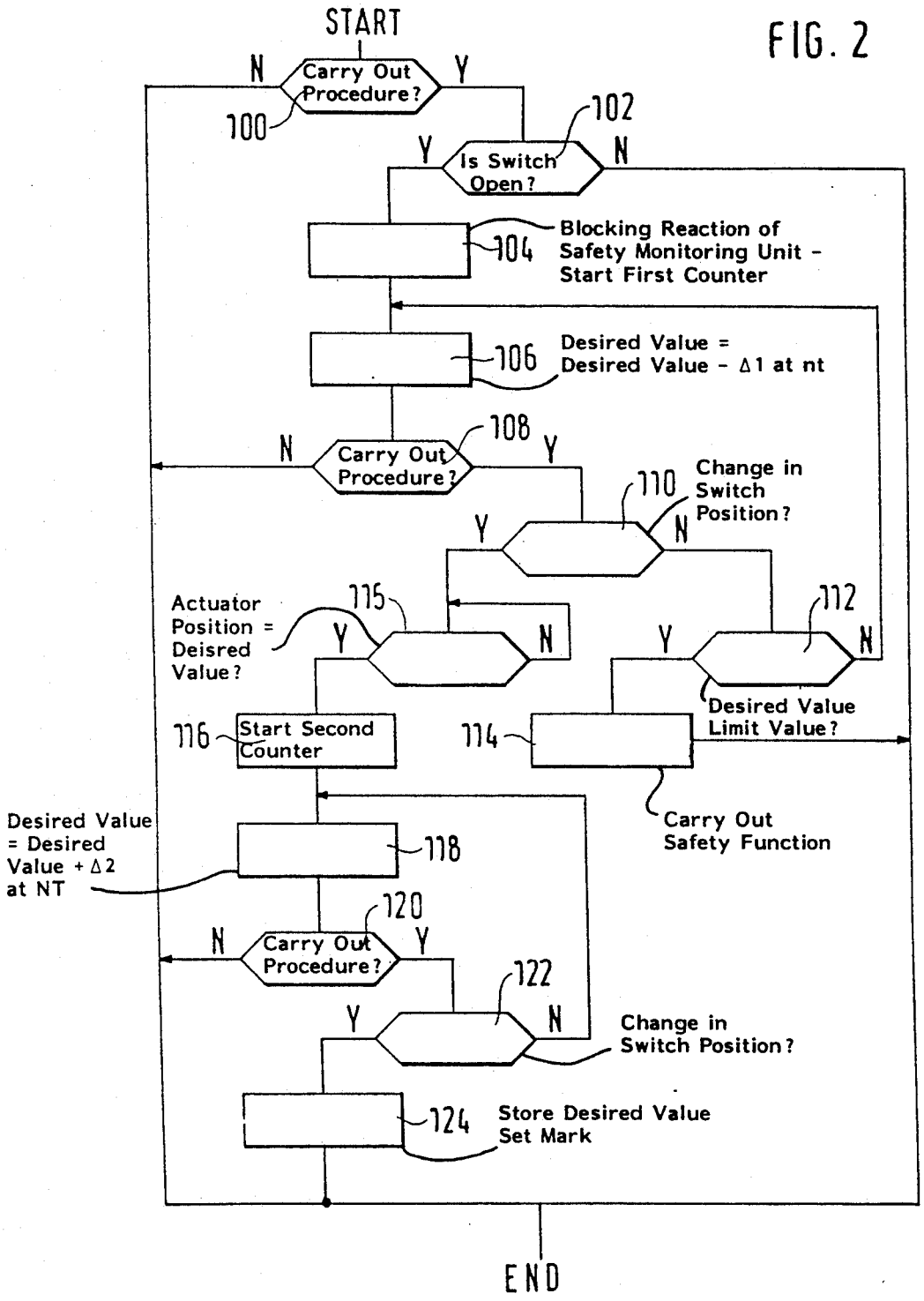
FIG. 2
START
Carry Out Procedure?
N
Y
100
102
Is Switch Open?
Y
N
104
Blocking Reaction of Safety Monitoring Unit - Start First Counter
106
Desired Value = Desired Value - Δ1 at nt
108
Carry Out Procedure?
N
Y
110
Change in Switch Position?
Y
N
Actuator Position = Deisred Value?
115
Y
N
112
Y
N
Desired Value Limit Value?
116
Start Second Counter
114
Carry Out Safety Function
Desired Value = Desired Value + Δ2 at NT
118
120
Carry Out Procedure?
N
Y
122
Y
N
Change in Switch Position?
124
Store Desired Value Set Mark
END

ARRANGEMENT FOR THE OPEN-LOOP AND/OR CLOSED-LOOP CONTROL OF AN OPERATING VARIABLE OF AN INTERNAL COMBUSTION ENGINE

FIELD OF THE INVENTION

The invention relates to an arrangement for open-loop and/or closed-loop controlling an operating variable of an internal combustion engine. The arrangement includes an electronic open-loop/closed-loop control unit; an actuable positioning actuator operating on the operating variable with the actuator being influenced by the open-loop/closed-loop control unit. The arrangement further includes a safety device which changes its signal in predetermined positions of the actuator.

BACKGROUND OF THE INVENTION

An arrangement of the kind described above is disclosed in the paper of G. Kolberg entitled "Elektronische Motorsteuerung for Kraftfahrzeuge" published in the journal "Motortechnische Zeitschrift", 46th year, Vol. 4, 1985. In this article, an electronic engine control system having an electronic open-loop/closed-loop control unit is described which operates on the operating variable to be open-loop or closed-loop controlled via an electrically actuable actuator. The control unit operates on the operating variable in dependence upon the operating variables of the engine and/or vehicle. This actuator is concerned with a positioning component determining the power of the engine such as the throttle flap or the injection pump of the engine. For this reason, safety means are connected with the positioning component and change their signal condition in dependence upon the particular position of the actuator; that is, the output signal of the safety device defines a jump-like trace in the form of a switching function in one or more specific positions of the actuator. This safety means is shown as switches with the change in signal condition being effected by a change in the switching mode.

Fault conditions of the electronic engine control system are derived from a comparison of the signal conditions and/or from the comparison of the signal conditions with other operating variables. The position of the actuator for which a change takes place in the signal condition is however subjected to mechanical and/or electrical tolerances and the effects of aging. In this way, in an unfavorable case, it is possible that the changes in signal condition are displaced from the predetermined position of the actuator wherein the change in signal condition should have normally taken place so that in a faulty manner, a fault condition of the electronic engine control system is detected or, in the opposite case, is not detected. In this way, the availability or operating reliability of the electronic engine control system is reduced.

SUMMARY OF THE INVENTION

It is an object of the invention to provide measures with the aid of which the availability and operating reliability of an electronic engine control system is improved.

This object is realized by providing means which control the actuator independently of the operating variables of the engine and/or of the motor vehicle for detecting the position of the change in signal condition.

Published German patent application 40 36 329 discloses an electro-mechanical accelerator pedal which has a so-called safety contact entrained therewith. The electro-mechanical accelerator pedal essentially comprises a shaft fixedly connected to the power-determining element with the shaft being coupled to the entrained safety contact so that this safety contact directly follows the movements of the shaft. This shaft can be controlled by an electric actuator in dependence upon a desired value formed from operating variables such as the position of a service element actuable by the driver and an actual value representing the position of the power-determining element. The range of movement of the electrical control is pregiven by a mechanical element which is connected to the service element actuable by the driver for controlling the power of the engine. In normal operation, the safety contact is closed, so that the electronic open-loop and closed-loop control unit recognizes the correct function of the system. If the power-determining element is actuated by the electric actuator in the direction "open" contrary to the request of the driver transmitted by the mechanical element so that an unwanted operating condition occurs, then the safety contact is opened by an appropriate stop on the mechanical element. The electronic open-loop and closed-loop control unit detects that a fault condition is present because of the changed signal condition of the safety means.

During full-load operation of the engine, the mechanical element as well as the shaft, actuable by the electrical actuator, are disposed in the their full-load positions. Because of tolerance effects (especially during full-load operation) the entrained safety contact can be opened even when there is no fault condition present so that the appropriate measures (such as emergency operation or bringing the motor vehicle to standstill) can be effected in an unwanted manner.

According to the invention, the actuator is controlled in pregiven operating conditions independently of the controlling operating variables for the detection of the change in the signal condition of the safety means. These measures increase the availability and the operational reliability of the engine and/or of the motor vehicle.

Fault announcements which are only based on tolerance and aging effects are effectively blanked out by the measures provided by the invention. This improves the availability of the motor vehicle.

The procedure provided by the invention further effectively avoids the fault announcements from being omitted and therefor improves the operational reliability of the motor vehicle. These fault announcements are based on tolerance or aging effects in the area of the safety means or in the area of the elements connected to the safety means.

By precisely detecting the changes of the signal condition, it becomes possible to adapt the safety monitoring to the tolerance and aging effects preferably by adapting the safety monitoring or, in the case of the electro-mechanical accelerator pedal described above, by limiting the throttle flap position at a desired full load.

BRIEF DESCRIPTION OF THE DRAWINGS

The invention will now be described with reference to the drawings wherein:

FIG. 2 is a flowchart for explaining the procedure according to the invention; and, FIG. 3 shows the signal traces influenced by the procedure of the invention.

DESCRIPTION OF THE PREFERRED EMBODIMENTS OF THE INVENTION

Figure 1:
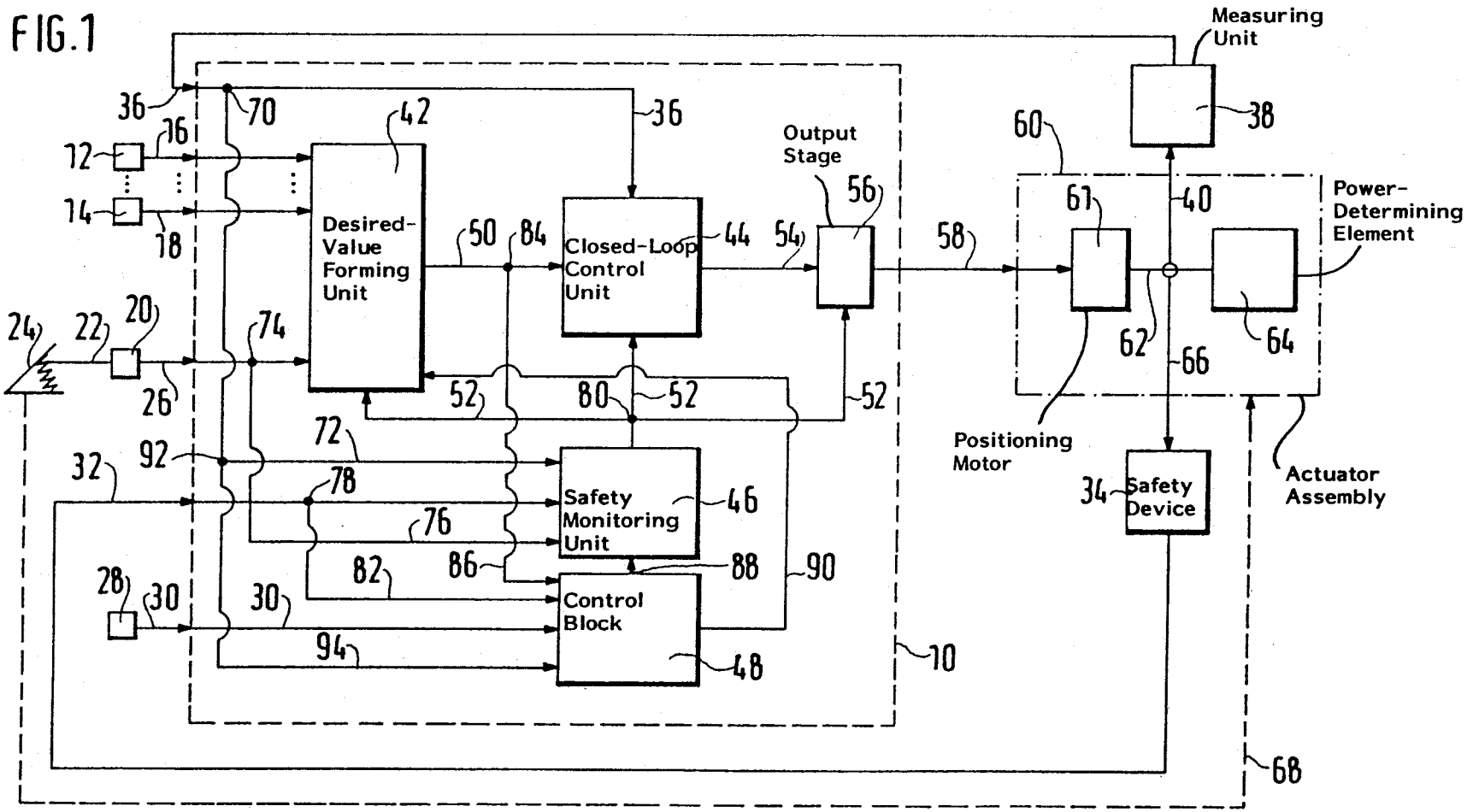
FIG. 1 is a block diagram of an electronic engine control system and/or an electro-mechanical accelerator pedal having safety means which changes its signal conditions.

FIG. 1 shows an electronic engine control system 10 to which operating variables of the engine and/or of the motor vehicle from measuring units 12 to 14 are supplied via lines 16 to 18, respectively. Also, a measuring unit 20 is provided which is connected via a rigid connection 22 to a service element 24 actuable by the driver. A line 26 connects the measuring unit 20 to the electronic engine control 10. Furthermore, measuring units are grouped together in block 28 which supply signals via lines 30 to the electronic engine control 10 with the signals representing the operating condition of other engine control systems such as the road-speed controller or the engine drag torque control (MSR) and/or information representing the operating condition of the engine such as start phase, restart phase and/or the emergency operating condition. Additional inputs of the electronic engine control 10 are defined by the line 32 which connects the electronic engine control 10 to the safety means 34 as well as the line 36 which connects the electronic engine control 10 to a measuring unit 38 which is connected via the rigid connection 40 to the power-determining actuator 64 of the engine.

The electronic engine control 10 comprises essentially a desired-value forming unit 42, a closed-loop unit 44, a safety monitoring device 46 as well as a control block 48. The function of the control block 48 will be explained further below.

The lines 16 to 18 as well as the lines 26 and 36 are connected to the desired-value forming unit 42 via an analog-to-digital converter (not shown). The output 50 of the desired-value forming unit 42 connects the latter to the control unit 44, the line 36 is also connected to the control unit 44. Also, a line 52 connects the safety monitoring device 46 to the control unit 44. The output of the control unit 44 is defined by the connecting line 54 which connects the control unit 44 to the output stage 56 via a digital-to-analog converter stage (not shown). The output line 58 of the output stage 56 at the same time defines the output line of the electronic engine control 10 and connects the engine control to an electrically actuable actuator 60 which includes a positioning motor 61, a power-determining element 64 of the engine (preferably a throttle flap or a diesel injection pump) and a mechanical connection 62 which connects the positioning motor 61 and element 64. A safety device 34 is connected via connection 66 to the mechanical connection 62. The safety device 34 preferably includes a switch or switching function generated by means of a position transducer. If the safety device 34 is a switch, then the switch changes its switching position in one or more predetermined positions of the actuator 60; on the other hand, if the safety device is a switching function, then the switching function changes the signal condition in one or more predetermined positions of the power-determining element 64.

In addition, a mechanical connection 68 can be provided between the service element 24 and the power-determining element 64. Reference may be made to German patent application P 40 36 329 directed to an electro-mechanical accelerator pedal for the configuration of the mechanical connection 68 as well as of the actuator 60 and the safety device 34.

A desired-value forming unit 42, control unit 44, monitoring unit 46 and control block 48 are preferably part of a computer system. Furthermore, a safety monitoring unit 46 is shown in FIG. 1 to which a line 72 is connected which is taken from line 36 at connecting node 70. In addition, a connecting line 76 is connected to safety monitoring unit 46 which is taken from line 26 at connecting node 74 as is line 32 via connecting node 78. The output line of the safety monitoring unit 46 defines the line 52 which is divided at connecting node 80 and from there is connected to the desired-value forming unit 42, the control unit 44 and/or the output stage 56. Input signals are supplied to control block 48 via line 30, connecting line 82, the connecting line 86 as well as the line 94. The connecting line 82 is taken from the line 32 at connecting node 78. The connecting line 86 is taken from line 50 at connecting node 84 and line 94 is taken from line 72 at connecting node 92. The output line 88 of the control block 48 connects the control block to the safety monitoring unit 46; whereas, a second output line 90 connects the control block 48 to the desired-value forming unit 42.

The operation of the block diagram of FIG. 1 is explained below.

The desired-value forming unit 42 forms a desired value for the position of the power-determining element 64 or for the position of the actuator 60 in dependence upon its input signals especially the input signals of the position of the service element actuable by the driver which is transmitted via the line 26 from the measuring unit 20. The desired value is supplied via the line 50 to the control unit 44. Additional operating variables of the engine and/or of the motor vehicle are supplied by the measuring units 12 to 14 via the lines 16 to 18, respectively, to the desired-value forming unit 42. These operating values are considered in the formation of the desired value and include especially engine speed, engine temperature, battery voltage, control signals for a drive-slip control (ASR) or engine drag torque control (MSR) intervention and road speed, etc. The control unit 44 receives the desired value formed in this manner via the line 50 and compares this desired value to the position of the power-determining element 64 or to the position of the actuator 60. This position is present via line 36 and is detected by the measuring unit 38. The control unit 44 forms a drive signal in the sense of a control of the actual value to the desired value in dependence upon the difference between these two signals. This drive signal is supplied to the electrically actuable actuator 60 and the positioning motor 61 via the line 54, the output stage 56 and the output line 58 for changing the position of the power-determining element 64.

In the following, several advantageous functions of the safety monitoring unit 46 are shown. In other embodiments and because of other peripheral conditions, it can be advantageous to provide plausibility comparisons in addition to the checks described with the plausibility comparisons being carried out between suitable signals for checking the correct function of the electronic engine control or it can be advantageous not to carry out several of the checks described below.

The safety monitoring unit 46 of FIG. 1 is supplied with the position of the actuator 60 or of the power-determining element 64, the position of the service element 24 actuable by the driver as well as the signals representing the signal condition of the safety device 34 with the signal condition of the safety device changing in a predetermined position of the actuator or, in the case of an electro-mechanical accelerator pedal of the kind mentioned above, in a pregiven combination of the accelerator pedal and the actuator position.

The safety monitoring unit 46 emits an alarm signal via its output line 52 when, for example, position signal values of the service element 24 and the position signal values of the actuator or the signal condition of the safety means are not plausible with respect to each other; that is, when, for example, the actuator is actuated when the accelerator pedal is not actuated. Also, an alarm signal is then emitted when the signal condition of the safety means is not plausible with respect to the position signal value of the actuator; that is, when for example, the position signal value indicates an actuated actuator and the signal condition of the safety means indicates a non-actuated actuator.

As noted above, German patent application DE 40 05 593 discloses an electro-mechanical accelerator pedal having a safety contact entrained therewith. With this arrangement, an alarm signal is emitted when a changed signal condition of the safety means is detected with respect to normal operation.

An alarm signal via line 52 leads for example to the following: suspending the controller unit 44, limiting the operation of the desired-value forming unit 42, switching off the output stage 56 and/or initiating known emergency driving measures or emergency disable measures.

The control block 48 detects the signal condition change and is active when none of the special operating conditions detected by block 28 are present and the desired value or accelerator pedal position have assumed predetermined values.

In the case of an electro-mechanical accelerator pedal having an entrained safety contact, the control block 48 becomes active when no MSR intervention or no road-speed control is present and the engine is not in the emergency condition and start and restart phases are terminated. In addition, the desired value or the position of the service element must exceed a pregiven threshold value in the region of the full-load position.

The safety means can for example be of the kind which changes its signal condition in a part-load position or idle position of the actuator 60. For this safety means, the presence of an overrun condition (for example, an overrun condition wherein the accelerator pedal has been released and there is an engine speed condition) is to be considered in lieu of the last condition. Then, the control block 48 can be active in the context of a test cycle.

The signal condition of the safety means is transmitted via the line 82 and the safety monitoring unit 46 is blocked by the line 88 with the activation of the control block 48. The procedure provided by the invention also includes influencing the desired-value forming unit 42 so that the safety means 34 changes its signal condition via an appropriate actuation of the actuator 60 via the controller 44. When this signal condition change 42 is detected, then the desired-value forming unit is first influenced in such a manner that the actuator 60 is again actuated in the direction in which a renewed signal condition change of the safety means 34 is to be expected. If the second signal condition change is detected via the line 82, then the actual position of the actuator 60 is determined as the position of the signal condition change of the safety means 34 and is stored via the line 88 and the line 90 in the safety monitoring unit 46 or the desired-value forming unit 42.

Figure 3:
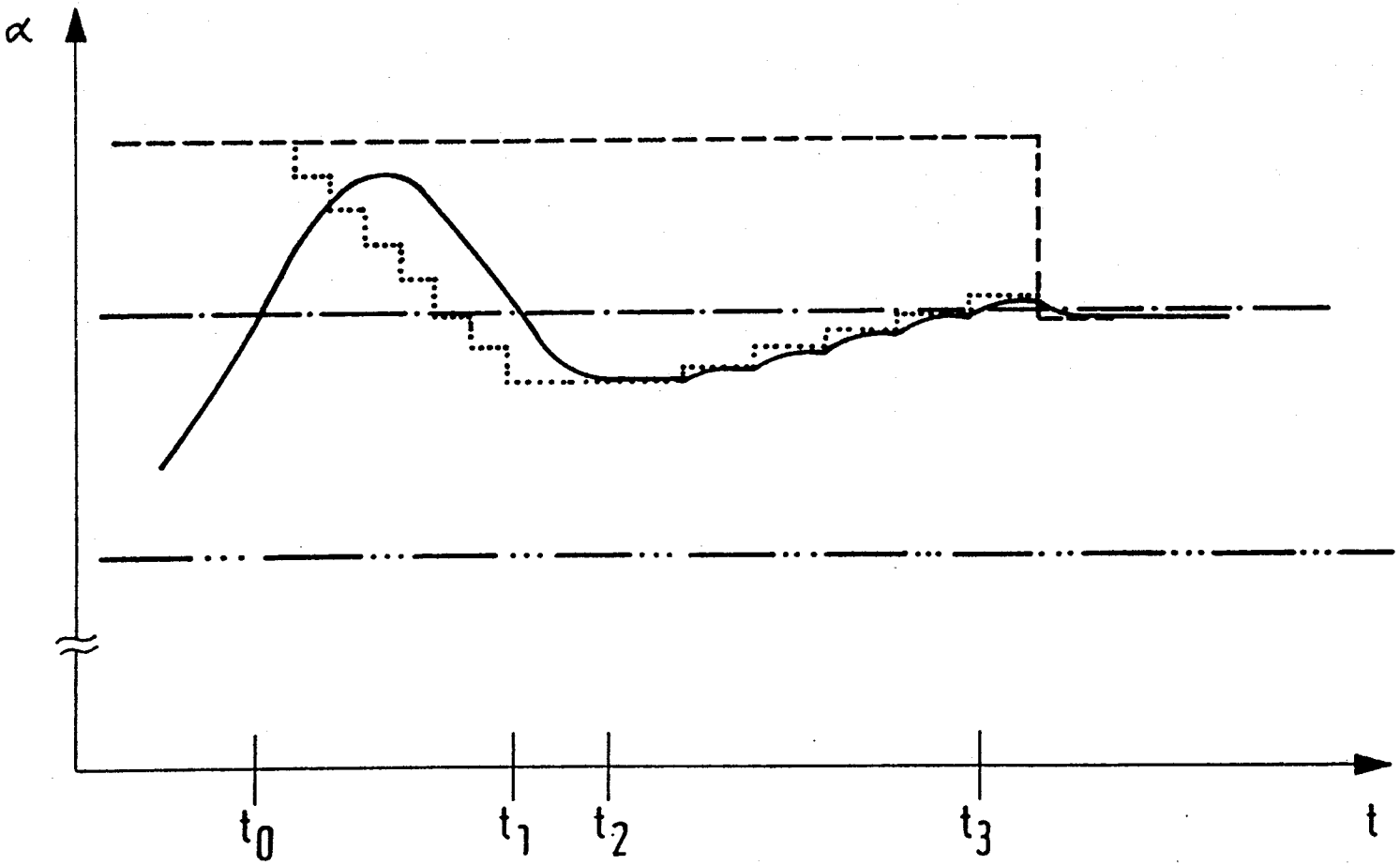

A detailed description of the operational sequences in the control block 48 is shown with respect to the flowchart of FIG. 2 as well as the time diagrams of FIG. 3 in the context of an example of an electro-mechanical accelerator pedal in the context of a preferred embodiment.

In addition to the functions described, the electronic engine control 10 can in one embodiment also undertake the functions known from the state of the art such as fuel metering or ignition time point adjustment.

FIG. 2 shows a flowchart which outlines the structure of a computer program for carrying out the procedure according to the invention in the context of the example of a switching contact known from German patent application 40 36 329 which has opened in an unwanted manner because of tolerance or aging effects when the system is in its full-load position.

After the start or call-up of this program part and the initialization of the counters and parameters used, a check is made in an inquiry step 100 as to whether the conditions are present which are required for carrying out the procedure of the invention. In the above-mentioned preferred embodiment, these conditions include the following: the start or restart phase is terminated, the additional functions which may be present including engine drag torque control (MSR) and road-speed controller are not active and that the engine is not in the emergency operation because of a fault condition and that the desired value for the position of the power-determining element supplied by the operator has exceeded a pregiven limit value lying in the region of the full-load stop. This limit value is selected in such a manner that the desired value imparted by the operator takes on a value which leads to a position of the power-determining element or the actuator wherein the safety switch with certainty does not open during normal operation while considering all tolerance and aging effects.

If these conditions are not fulfilled, then the program part is ended; otherwise, a check is made in inquiry block 102 as to the switching condition of the switch. If the switch is closed, then with respect to the embodiment related to the electro-mechanical accelerator pedal, no necessity is present for detecting the position of the signal condition change. The program part is therefore ended.

When a signal condition change is detected which takes place in the part-load or idle regions, then it is desired to dispense with this condition and carry out the program part shown in FIG. 2 in the context of a text cycle, for example, during overrun operation.

If the determination is made in inquiry step 102 that the safety switch is open and a fault condition is possibly indicated, then the program continues in step 104 with inhibiting the response of the safety monitoring unit and the starting of a first counter.

The steps 106 to 112 which follow describe a time-dependent, ramp-shaped return of the actuator up to the detection of a change of the signal condition of the safety switch or the threshold value described above has been reached.

In step 106 the desired value is lowered by a pregiven value $\Delta 1$ when a pregiven time interval (nt) has passed.

In step 108, a renewed check of the conditions listed initially takes place with the program part being ended when an intermediate change of the operating condition of the engine has taken place. In the opposite case, the signal condition of the safety switch is checked in step 110 for a change which has taken place in the meantime; that is, whether the safety switch has been transferred from the open into the closed condition. If this is not the case, then in step 112, the actual desired value is compared to a threshold value which lies in the region of the full-load value and which considers all tolerance and aging effects. If the desired value has not reached this value, then the desired value is again lowered in step 106 by a pregiven value A1 when the next time interval (nt) has run. With these measures, a stepwise reduction of the desired value takes place, and in this way, of the actuator position at pregiven time intervals as shown below with respect to FIG. 3. If the signal condition of the safety switch has not changed even though the desired value has reached the threshold pregiven in step 112 or has dropped therebelow, then it can be assumed that a fault condition of the system is present since the safety switch does not close. After step 112, the corresponding safety reaction is carried out in step 114 which as a rule includes a switch-off of the metering of fuel or a limiting of the desired value, the actuator position and/or the quantity of fuel to a pregiven value so that an emergency operation of the motor vehicle is possible. The program part is ended after step 114.

If a change of the signal condition of the safety switch is detected in the course of the loop of the steps 106 to 112 in inquiry step 110, then the inquiry is made in step 115 as to whether the position of the actuator corresponds to the position given by the desired value. If this is the case, then a second counter (T) is started in step 116 and a second loop, which includes steps 118 to 122, is initiated. This loop leads to a time-dependent stepwise approach of the desired value or of the actuator position to the position wherein a change of the switching condition of the switch takes place from the closed condition to the open condition. In step 118, the position of the positioning component is increased by a pregiven value Δ2, which is advantageously less than the value Δ1, when a pregiven time interval NT has run. In this case, it is to be noted that as a consequence of the system delay time, the time interval NT is longer than the time interval nt so that the positioning component synchronously follows the time-dependent step-shaped change of the desired value. In step 120, corresponding to step 100 or 108, a check takes place as to the conditions for carrying out the procedure of the invention. If these conditions are not fulfilled any longer, the program part is ended. In the other case, the change of the signal condition of the switch is detected in step 122. If the switch is still in its closed condition, that is, nothing has changed with respect to the situation of step 112, then the loop of steps 118 to 122 is repeated. If a signal condition change has taken place, then the desired value and/or the position of the actuator for a change of the signal condition is stored in step 124 and the full-load position of the actuator is limited to a value which lies by Δ2 below the position which the throttle flap had when the signal condition was detected. In addition, a mark is set for diagnostic reasons, which indicates that the safety switch was opened because of tolerance and aging effects. After step 124 the program part is ended.

The steps 108 and 120 are not present in a further embodiment.

As shown in FIG. 3, the mean slope of the ramp when returning the throttle flap is steeper than when again returning to the switching point of the safety switch. This can be based on the condition that the return, that is the closure of the safety switch, must for reasons of safety take place more rapidly so that when there is a possible faulty performance of the system, a safety reaction can take place after a certain time has elapsed. The reopening of the positioning component must, in contrast, take place so slowly that a precise detection of the signal condition change or switch point is possible. The mean slope of the ramp is therefore to be selected so that the position of the positioning component can follow the pregiven changes of the desired value input. That is, the time interval NT must be so selected that a change of the actuator position can only take place when the actual actuator position has reached the pregiven changed position.

FIG. 3 shows the measures according to the invention and the operation of the flowchart of FIG. 2 with respect to characteristic signal traces, which are not shown to scale in FIG. 3.

FIG. 3 shows a time diagram wherein values ($\alpha$) representing the positioning component position and the desired value, are shown on the vertical axis while time (t) is shown on the horizontal axis. In this way, the broken line shows the desired value pregiven by the operator via the actuable service element, that is, the operator's desire. The upper broken line shows the switching threshold of the safety contact which is included for emphasis. The lower broken line represents the tolerance threshold of the desired value checked in step 110. The solid line corresponds to the actual actuator position whereas the dotted signal trace shows the time trace of the influenced desired value.

After the driver has adjusted the desired value to its full-load value by actuating the service element and the actuator has followed the operator's wish, the opening of the safety switch is detected at time point $t_0$. Assuming that the above-mentioned conditions are present, this has the consequence that the desired value of the system is controlled in such a manner that the actuator is influenced in sense of a closure. As described above, the desired value is reduced with time in steps by a pregiven value Δ1 for every time interval nt. The system delay leads to a time-delayed follow-up movement of the actuator. At time $t_1$, a renewed closure of the safety switch is detected and the manipulation of the desired value is ended. At time point $t_2$, the actual position of the actuator reaches the desired value. Thereafter, and in accordance with FIG. 2, the actuator is again influenced in the sense of an opening. After time intervals NT have elapsed, which are significantly longer than the time intervals nt, the desired value is increased by a pregiven value Δ2. The actuator position follows the changed input of the desired value so that after ending each time interval NT, the actual position of the actuator corresponds to the pregiven position. At time point $t_3$, a renewed opening of the switch is detected. Based on the desired selection of the time interval NT as well as the increment Δ2, it can be assumed that for the actuator position present at time point $t_3$, the signal condition change of the safety means takes place. This value is then stored as the switch point of the safety means. Furthermore, after the present time interval NT has run, the desired value is lowered by Δ2 and the actuator position or the desired value is limited to this value. Accordingly, the operator wish cannot exceed this limit value. During this operating cycle, the actuator can therefore not exceed the pregiven limit value, that is, the switch cannot open because of tolerance and aging effects.

If this limit value is reached in one of the next operating cycles, then the opening of the actuator is continued in order to detect a change of the signal condition change position which possibly occurred in the meantime. If the limit value detected in the manner described above deviates in a later operating cycle from the stored value by a pregiven value, then the stored value is replaced by the new value.

If the engine is in an operating condition which is characterized by a lowered battery voltage then an increased delay time results between the desired value change and the actuator position change. Accordingly, additional measures are to be undertaken in this kind of operating condition. These measures preferably include limiting the desired value of the system to the lower threshold value shown in FIG. 3 which is pregiven by considering tolerance and aging effects. A further advantageous possibility is to limit the slope change of the desired value above this threshold in such a manner that too large a difference between the desired value trace and the actuator position trace is prevented.

The procedure provided by the invention has been described with respect to the safety switch disclosed in German patent application 40 36 329 which can open in an unwanted manner in the full-load position of the positioning component because of tolerance and aging effects.

This procedure of the invention can be transferred to obtain a precise determination of a signal condition change of a switch which serves as a safety means in an electronic engine control system. The procedure described above is advantageously carried out in the context of a test cycle during overrun operation of an engine with the individual steps being correspondingly changed and the stored value of the actual signal condition change being considered with plausibility comparisons of the signal condition to a corresponding position signal in that the positioning value, at which a signal position change should take place, is corrected correspondingly.

A further advantageous application of the invention is seen in connection with an accelerator pedal transducer having safety means when adjusting the same at the end of the production process of a motor vehicle.

It is understood that the foregoing description is that of the preferred embodiments of the invention and that various changes and modifications may be made thereto without departing from the spirit and scope of the invention as defined in the appended claims.

What is claimed is:

1. An arrangement for controlling an internal combustion engine, the arrangement comprising:

sensor means for detecting an operating parameter of the engine or motor vehicle and for supplying a sensor signal indicative of said operating parameter;

an electrically actuable actuator;

desired-value forming means connected to said sensor means and adapted for forming a desired value for the position of said actuator based on said operating parameter;

first control means for forming a drive signal in dependence upon said desired value to actuate said actuator;

safety circuit means operatively connected to said actuator for providing an output signal which changes from a first signal level to a second signal level in at least one predetermined position of said actuator;

detection means detecting the position of said actuator for providing a detection signal indicative of said position;

second control means for driving said actuator independently of said desired value during pregiven operating states of the engine or motor vehicle with said actuator being driven in such a manner that a change of said signal level takes place; and, plausibility comparison means for comparing the level of said output signal to said detection signal to determine the presence of a fault condition in at least one of said detection means and said actuator.

2. The arrangement of claim 1, further comprising: an electronic engine power controller and said actuator being connected to said power controller; and, said safety circuit means being connected to said actuator and including switching means for defining said signal level as a switching function in a predetermined position of said actuator.

3. The arrangement of claim 1, further comprising an electro-mechanical accelerator pedal and said actuator being connected to said pedal; and, said safety circuit means being connected to said actuator and including switching means for defining said signal level as a switching function which changes for a position of the actuator pregiven with reference to the position of the pedal.

4. The arrangement of claim 1, further comprising:

first ancillary control means for controlling said actuator in pregiven operating conditions of the engine in the sense of a change of said signal level;

first detecting means for detecting said change of said signal level;

second ancillary control means for controlling said actuator in the sense of a renewed change of said signal level;

second detecting means for detecting said renewed change of said signal level; and, means for storing the position of said actuator corresponding to said change of said signal level.

5. The arrangement of claim 1, said first control means being adapted to control the position of said actuator independently of a second operating variable when a first change in said signal level has been detected, said first change being in the sense of a renewed change of the signal level; and, when there is a renewed change in said signal level, and first control means being further adapted to control said actuator in the sense of a third change in said signal level and, said first control means including means for storing the position of said actuator corresponding to said third change of said signal level.

6. The arrangement of claim 1, wherein said actuator is controlled by correspondingly influencing the desired value.

7. The arrangement of claim 1, wherein pregiven operating conditions of the engine include overrun operation and full-load operation.

8. The arrangement of claim 1, wherein the position of said actuator is controlled by time-dependent ramp pulses and step-shaped pulses.

9. The arrangement of claim 1, wherein the control of the position of said actuator takes place in the sense of producing the first change in the signal level with at least one of a plurality of ramp slopes, step forms, step heights and step lengths different than the control for producing the second change in signal level.

10. The arrangement of claim 1, further comprising an electro-mechanical gas pedal having a safety contact entrained therewith, said contact indicating a defective performance at one signal level, the control of the actuator taking place during the full-load condition when said signal level is present.

11. The arrangement of claim 10, wherein a threshold is defined and an emergency driving operation is initiated when said threshold is reached without detecting a change in the signal level.

12. The arrangement of claim 10, wherein the desired value is limited to a stored position value and a renewed detection of the change in signal level is carried out when this limit value is reached in a next-following operating cycle with a new value being stored when this new value deviates from the stored value.

13. The arrangement of claim 1, wherein pregiven operating conditions of the engine include overrun operation.

14. The arrangement of claim 1, wherein the position of said actuator is controlled by time-dependent ramp pulses.

15. The arrangement of claim 1, wherein pregiven operating conditions of the engine include full-load operation.

16. The arrangement of claim 1, wherein the position of said actuator is controlled by step-shaped pulses.

* * * * *

UNITED STATES PATENT AND TRADEMARK OFFICE

CERTIFICATE OF CORRECTION

PATENT NO. : 5,233,958

DATED : August 10, 1993

INVENTOR(S) : Martin Knoss, Bernd Lieberoth-Leden and Diethard Loehr

It is certified that error appears in the above-identified patent and that said Letters Patent is hereby corrected as shown below:

In column 7, line 14: delete "A1" and substitute -- Δ1 -- therefor.

In column 10, line 52: delete "and" and substitute -- said -- therefor.

Signed and Sealed this

Twenty-ninth Day of March, 1994

*Attest:*

*Attesting Officer*

BRUCE LEHMAN

*Commissioner of Patents and Trademarks*